US006164414A

United States Patent [19]

Duty

[11] Patent Number: 6,164,414

[45] Date of Patent: Dec. 26, 2000

[54] AUTOMOTIVE LIFT APPARATUS

[76] Inventor: Billy G. Duty, Rte. 2, Box 201, Grundy, Va. 24614

[21] Appl. No.: 09/320,990

[22] Filed: May 27, 1999

[51] Int. Cl.[7] ..... B66F 7/10

[52] U.S. Cl. ..... 187/210; 187/210; 187/211; 187/217; 187/220; 254/88; 254/90; 254/8 B

[58] Field of Search ..... 254/88, 90, 8 B; 187/203, 204, 210, 211, 213, 215–220, 240; 414/390, 391, 399

[56] References Cited

U.S. PATENT DOCUMENTS

| | | | |
|---|---|---|---|
| 1,847,719 | 3/1932 | Hirschel . | |
| 1,938,446 | 12/1933 | Bacher . | |
| 2,922,533 | 1/1960 | La Barge, Jr. | 187/211 X |
| 3,051,340 | 8/1962 | Ely | 187/211 X |
| 3,294,367 | 12/1966 | Liskey . | |
| 3,804,206 | 4/1974 | Bubik . | |
| 4,323,141 | 4/1982 | Ragan et al. . | |
| 4,447,042 | 5/1984 | Masui | 187/217 X |
| 4,724,875 | 2/1988 | Baldwin et al. | 187/211 X |
| 5,427,497 | 6/1995 | Dillman | 414/390 X |
| 6,070,699 | 1/1960 | Bleeker | 187/211 X |

FOREIGN PATENT DOCUMENTS

| | | | |
|---|---|---|---|
| 20783 | 12/1945 | Finland | 187/211 |
| 1944728 | 12/1945 | Germany | 187/211 |

*Primary Examiner*—Robert P. Olszewski
*Assistant Examiner*—Thuy V. Tran

[57] ABSTRACT

An automotive lift apparatus includes a first beam support assembly and a pair of beams supported at first beam ends by the first beam support assembly, wherein each of the beams includes an outward facing beam guide portion and an inward facing guide portion. A pair of ramp/second beam support assemblies are connected to second beam ends of the beams, and each of the ramp/second beam support assemblies includes a second base. A liftable ramp is hingedly connected to the second base, and a ramp lift assembly is connected between the ramp and the second base. The first beam support assembly includes a beam support base and a beam support riser pivotally connected to the beam support base. Each of the ramp lift assemblies includes a ramp-lift hydraulic cylinder connected between the second base and the ramp. Each of the ramp/second beam support assemblies includes a riser link hingedly connected between each of the ramps and the second beam ends. A variety of utility assemblies are supported by either the inward facing guide portions or the outward facing beam guide portions. Such utility assemblies include vertically oriented first hydraulic jacks, wheel racks, brake drum racks, a frame jack assembly, waste oil reclamation units, work platform assemblies, and an interior hoist assembly.

27 Claims, 6 Drawing Sheets

FIG 10
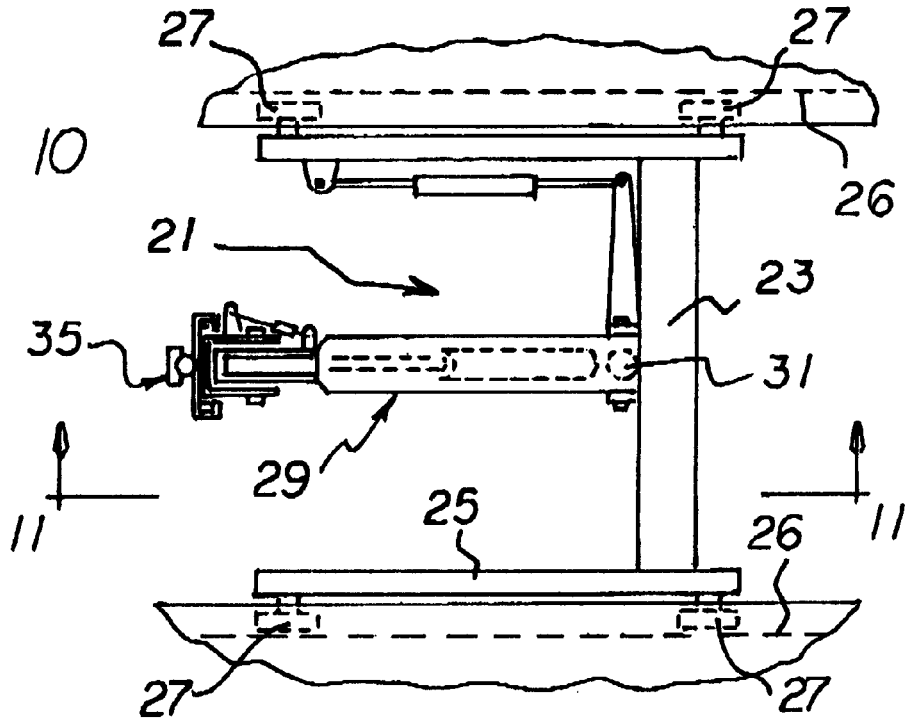
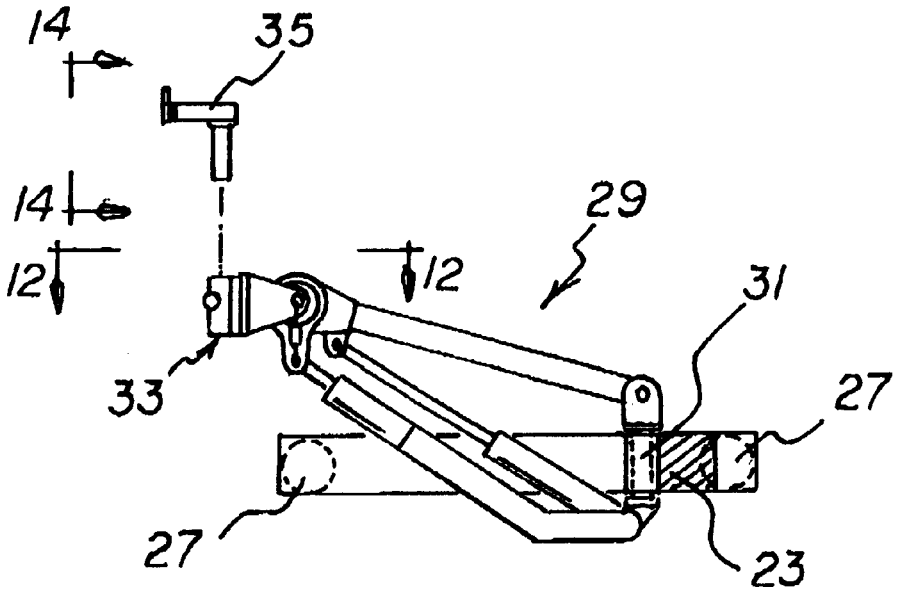
FIG 11

AUTOMOTIVE LIFT APPARATUS

BACKGROUND OF THE INVENTION

1. Field of the Invention

The present invention relates generally to lifting devices, and, more particularly, to lifting devices especially adapted for lifting automotive vehicles off of the ground for servicing.

2. Description of the Prior Art

Lifting automotive vehicles off of the ground for servicing has been done for many years. In this respect, throughout the years, a large number of innovations have been developed relating to automotive vehicle lifts, and the following U.S. patents are representative of some of those innovations: U.S. Pat. Nos. 1,847,719, 1,938,446, 3,294,367, 3,804,206, and 4,323,141. More specifically, U.S. Pat. No. 1,847,719 a rack device for supporting an automotive vehicle over an in-ground pit for maintenance operations. Generally, pits for the maintenance and repair of automotive vehicles are not common in many instances. In this respect, it would be desirable if a rack for automotive vehicles were provided that does not need an in-ground pit.

U.S. Pat. No. 1,938,446 discloses a vehicle lift that includes a pedestal containing support for beams that support an automotive vehicle. The pedestal extends from and contracts into an in-ground channel. Often, in-ground channels for pedestals are not readily available, and in this respect, it would be desirable if an automotive lift apparatus were provided that does not require an in-ground pedestal.

U.S. Pat. No. 3,294,367 discloses a supporting rack for an automotive vehicle that employs a see-saw like device with a fulcrum centrally located between opposite ends of the supporting rack. Once the automotive vehicle is on the rack, the automotive vehicle remains supported by the wheels of the vehicle on the rack. However, there are times when wheels, or items associated with wheels, must be serviced. To do so, the vehicle must be lifted higher so that the wheels of the vehicle do not rest upon the rack. Therefore, it would be desirable if an automotive vehicle rack were provided that lifts the wheels of the vehicle off of the rack.

U.S. Pat. No. 3,804,206 discloses a ramp containing hoist for an automotive vehicle. As described above, this device does not provide for lifting the vehicle wheels off of the ramp.

U.S. Pat. No. 4,323,141 discloses a rail-mounted vehicle jack that is mounted on rails between a pair of hoist platforms. Although numerous motor vehicle maintenance tasks require the use of a jack, there are also maintenance tasks which do not require the use of a jack. For example, once a motor vehicle is on a rack, without the use of a jack, one may wish to change the motor oil of the vehicle. To do so, it would be desirable if an automotive lift apparatus included features for receiving and removing waste oil from the motor vehicle.

Still other features would be desirable in an automotive lift apparatus. For example, not only is it desirable to have one vehicle jack that can be located at substantially any desired position underneath the motor vehicle, it would also be desirable if two motor vehicle jacks were provided so that both the front and the rear of the vehicle can be jacked up to maintain the jacked up vehicle in a level orientation.

There are times when maintaining a motor vehicle requires lifting components from above the vehicle. In this respect, it would be desirable if an automotive lift apparatus included an overhead hoist assembly. Not only would it be desirable for an overhead hoist to be provided, it would also be desirable if an overhead hoist were able to be located at substantially any longitudinal position along the ramps of the automotive lift apparatus.

Once a motor vehicle is elevated on a rack, it may be desirable to provide an elevated work platform upon which an automobile mechanic can stand while doing work under the hood of the motor vehicle.

For an overhead hoist, it would be desirable if a variety of fixtures can be interchangeably substituted at ends of the hoist. In this respect, it would be desirable if an easily operated locking system were provided to lock interchanged fixtures into the hoist.

Once a motor vehicle is on an automotive lift apparatus and once the wheels are elevated off of the ramps, it would be desirable if a mechanism were provided from moving wheels and brake drums away from the vehicle.

Thus, while the foregoing body of prior art indicates it to be well known to use racks or lifts for automotive vehicles, the prior art described above does not teach or suggest an automotive lift apparatus which has the following combination of desirable features: (1) does not require the use of in-ground pit; (2) does not require an in-ground pedestal; (3) lifts the wheels of the vehicle off of the rack; (4) includes features for receiving and removing waste oil from the motor vehicle; (5) provides two motor vehicle jacks so that both the front and the rear of the vehicle can be jacked up to maintain the jacked up vehicle in a level orientation; (6) includes an overhead hoist assembly; (7) provides an overhead hoist that can be located at substantially any longitudinal position along the ramps of the apparatus; (8) provides an elevated work platform upon which an automobile mechanic can stand while doing work under the hood of the motor vehicle; (9) provides an easily operated locking system to lock interchanged fixtures into the hoist; and (10) provides a mechanism for moving wheels and brake drums away from a vehicle. The foregoing desired characteristics are provided by the unique automotive lift apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an automotive lift apparatus which includes a first beam support assembly and a pair of beams supported at first beam ends by the first beam support assembly, wherein each of the beams includes an outward facing beam guide portion and an inward facing guide portion. A pair of ramp/second beam support assemblies are connected to second beam ends of the beams, and each of the ramp/second beam support assemblies includes a second base. A liftable ramp is hingedly connected to the second base, and a ramp lift assembly is connected between the ramp and the second base. The first beam support assembly includes a beam support base and a beam support riser pivotally connected to the beam support base. Each of the ramp lift assemblies includes a ramp-lift hydraulic cylinder connected between the second base and the ramp. Each of the ramp/second beam support assemblies includes a riser link hingedly connected between each of the ramps and the second beam ends.

A first utility assembly is supported by the inward facing guide portions. In one embodiment of the invention, the first utility assembly includes vertically oriented first hydraulic jacks. The first hydraulic jacks are carried by a jack carriage assembly which includes jack carriage rollers received in the inward facing guide portions.

A second utility assembly is supported by the outward facing beam guide portions. The second utility assembly includes second utility assembly rollers received in the outward facing beam guide portions. A telescopic second utility assembly extension unit is suspended from the second utility assembly rollers and extends transversely below the beams. Second utility work units are supported by the telescopic second utility assembly extension unit. Each of the second utility work units includes an extensible/contractible support rod received in the telescopic second utility assembly extension unit. A task performance unit support strut is supported by the extensible/contractible support rod, and a task performance unit is supported by the task performance unit support strut. The task performance unit includes a wheel rack. The task performance unit also includes a brake drum rack.

A third utility assembly is supported by the first beam support assembly, and the third utility assembly includes a frame jack assembly.

With another embodiment of the invention, the first utility assembly includes a first waste oil reclamation unit. A suction line is connected to the first waste oil reclamation unit. The first waste fluid reclamation unit includes a first reclamation funnel, a first flexible conduit connected to the first reclamation funnel, and a first fluid reception tank connected to the first flexible conduit. The suction line is connected to the first fluid reception tank.

A fourth utility assembly is supported by the outward facing beam guide portions, and the fourth utility assembly includes a second waste oil reclamation unit. The second waste oil reclamation unit includes a second reclamation funnel. A second flexible conduit is connected to the second reclamation funnel, and a second fluid reception tank is connected to the second flexible conduit. The second fluid reception tank is connected to the suction line.

With another embodiment of the invention, the second utility work units of the second utility assembly can include work platform assemblies supported by the task performance unit support strut. In this respect, each of the work platform assemblies includes a platform member. A pair of handrails extend upward from the platform member, and a set of stairs extend downward from the platform member. In addition, a side hoist assembly can be connected to a beam.

With yet another embodiment of the invention, an interior hoist assembly is supported by the inward facing guide portions of the beams. The interior hoist assembly includes an interior hoist carriage assembly which includes rollers supported by the inward facing guide portions. A pair of roller support struts is connected to the rollers. A transverse carriage strut is connected between the pair of roller support struts. An interior hoist unit is provided, and a pivot connects the interior hoist unit to the transverse carriage strut. A rotator assembly, which includes hydraulic cylinders and pistons, is connected between one of the roller support struts and the interior hoist unit for rotating the interior hoist unit around the pivot.

The interior hoist unit includes a fixture reception assembly, and a fixture is received in the fixture reception assembly. The fixture reception assembly includes a fixture reception channel for receiving a portion of the fixture, and a fixture securing assembly secures the fixture to the fixture reception assembly. The fixture securing assembly includes an externally threaded cam reception shaft. A pair of internally threaded locking cams is connected to the threaded cam reception shaft, and a pair of cam drivers are provided for moving the locking cams along the threaded cam reception shaft. The fixture includes a vertical stem inserted into the fixture reception channel, and a horizontal rest assembly is supported by the vertical stem.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automotive lift apparatus which has all of the advantages of the prior art and none of the disadvantages.

It is another object of the present invention to provide a new and improved automotive lift apparatus which may be easily and efficiently manufactured and marketed.

It is yet another object of the present invention to provide a new and improved automotive lift apparatus which is of durable and reliable construction.

Another object of the present invention is to provide a new and improved automotive lift apparatus which is susceptible of a low cost of manufacture with regard to both materials and labor, and which accordingly is then susceptible of low prices of sale to the consuming public, thereby making such automotive lift apparatus available to the buying public.

Still another object of the present invention is to provide a new and improved automotive lift apparatus which does not require the use of in-ground pit.

Still a further object of the present invention is to provide a new and improved automotive lift apparatus that does not require an in-ground pedestal.

Yet another object of the present invention is to provide a new and improved automotive lift apparatus which lifts the wheels of the vehicle off of the rack.

Even another object of the present invention is to provide a new and improved automotive lift apparatus that includes features for receiving and removing waste oil from the motor vehicle.

An even further object of the present invention is to provide a new and improved automotive lift apparatus which provides two motor vehicle jacks so that both the front and the rear of the vehicle can be jacked up to maintain the jacked up vehicle in a level orientation.

Yet another object of the present invention is to provide a new and improved automotive lift apparatus that includes an overhead hoist assembly.

Still a further object of the present invention is to provide a new and improved automotive lift apparatus which provides an overhead hoist that can be located at substantially any longitudinal position along the ramps of the apparatus.

Yet another object of the present invention is to provide a new and improved automotive lift apparatus that provides an elevated work platform upon which an automobile mechanic can stand while doing work under the hood of the motor vehicle.

Still a further object of the present invention is to provide a new and improved automotive lift apparatus that provides an easily operated locking system to lock interchanged fixtures into the hoist.

Yet another object of the present invention is to provide a new and improved automotive lift apparatus which provides a mechanism for moving wheels and brake drums away from a vehicle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 10 is a top view of a fourth embodiment of the invention which includes a drive train lift unit.

FIG. 11 is a cross-sectional view of the embodiment of the invention shown in FIG. 10 taken along line 11—11 thereof.

DESCRIPTION OF THE PREFERRED EMBODIMENT

Figure 1:
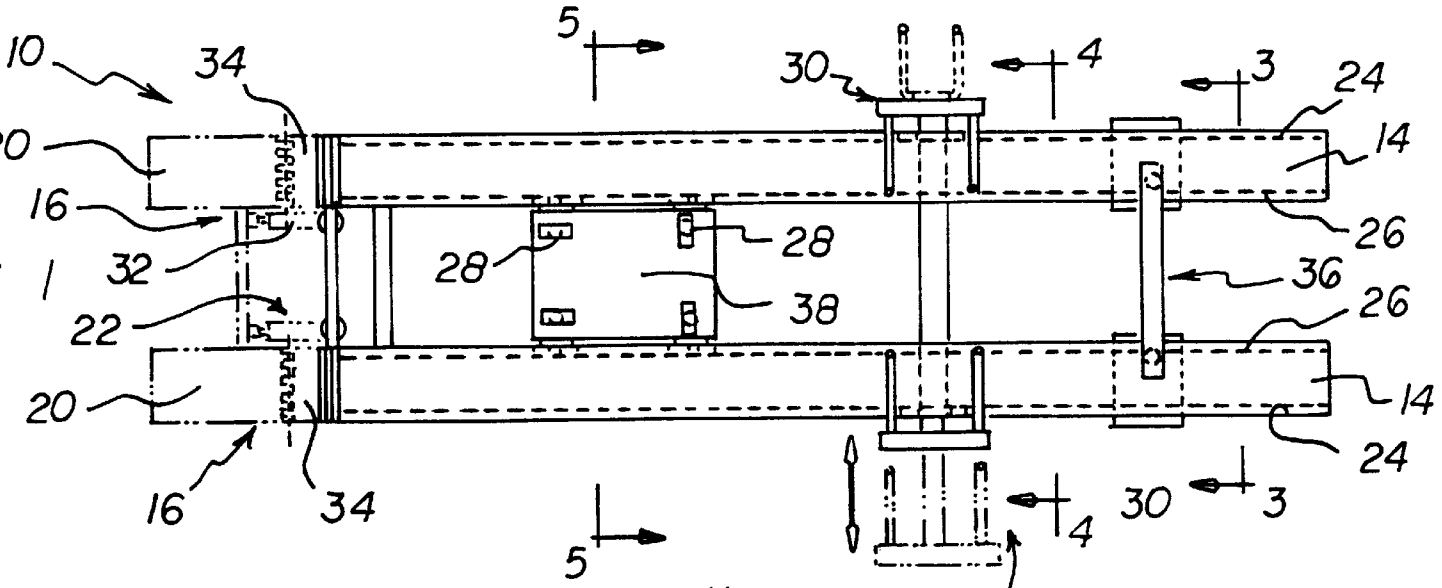
FIG. 1 is a top view showing a first embodiment of the automotive lift apparatus of the invention.

With reference to the drawings, a new and improved automotive lift apparatus embodying the principles and concepts of the present invention will be described.

Turning to FIGS. 1–5, there is shown a first embodiment of the automotive lift apparatus of the invention generally designated by reference numeral 10. In the first embodiment, the automotive lift apparatus 10 includes a first beam support assembly 12 and a pair of beams 14 supported at first beam ends by the first beam support assembly 12, wherein each of the beams 14 includes an outward facing beam guide portion 24 and an inward facing guide portion 26. A pair of ramp/second beam support assemblies 16 are connected to second beam ends of the beams 14, and each of the ramp/second beam support assemblies 16 includes a second base 18. A liftable ramp 20 is hingedly connected to the second base 18, and a ramp lift assembly 22 is connected between the ramp 20 and the second base 18. The first beam support assembly 12 includes a beam support base 82 and a beam support riser 84 pivotally connected to the beam support base 82. Each of the ramp lift assemblies 22 includes a ramp-lift hydraulic cylinder 32 connected between the second base 18 and the ramp 20. Each of the ramp/second beam support assemblies 16 includes a riser link 34 hingedly connected between each of the ramps 20 and the second beam ends.

A first utility assembly is supported by the inward facing guide portions 26. The first utility assembly includes vertically oriented first hydraulic jacks 28. The first hydraulic jacks 28 are carried by a jack carriage assembly 38 which includes jack carriage rollers 40 received in the inward facing guide portions 26.

A second utility assembly is supported by the outward facing beam guide portions 24. The second utility assembly includes second utility assembly rollers 42 received in the outward facing beam guide portions 24. A telescopic second utility assembly extension unit 44 is suspended from the second utility assembly rollers 42 and extends transversely below the beams 14. Second utility work units 46 are supported by the telescopic second utility assembly extension unit 44. Each of the second utility work units 46 includes an extensible/contractible support rod 48 received in the telescopic second utility assembly extension unit 44. A task performance unit support strut 52 is supported by the extensible/contractible support rod 48, and a task performance unit is supported by the task performance unit support strut 52. As shown in FIGS. 1–4, the task performance unit includes a wheel rack 50. The task performance unit also includes a brake drum rack 54.

A third utility assembly is supported by the first beam support assembly 12. The third utility assembly includes a frame jack assembly 36.

Figure 2:
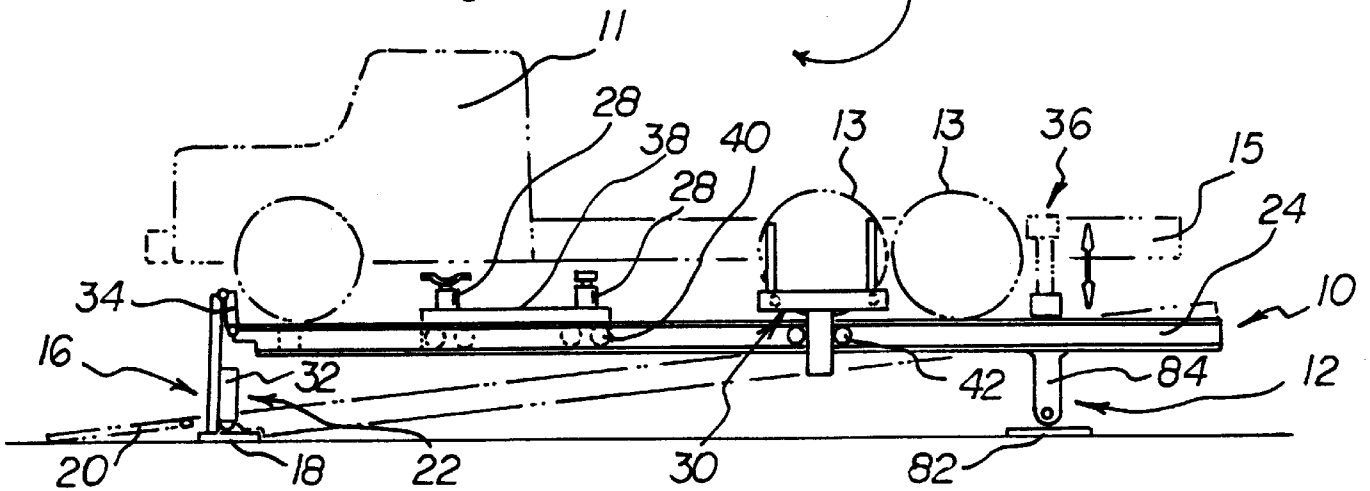
FIG. 2 is a side view of the embodiment of the automotive lift apparatus shown in FIG. 1 with a truck shown in broken lines.
Figure 3:
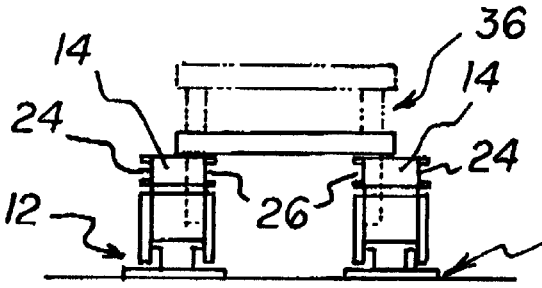
FIG. 3 is a cross-sectional view of the embodiment of the automotive lift apparatus of FIG. 1 taken along line 3—3 thereof.
Figure 4:
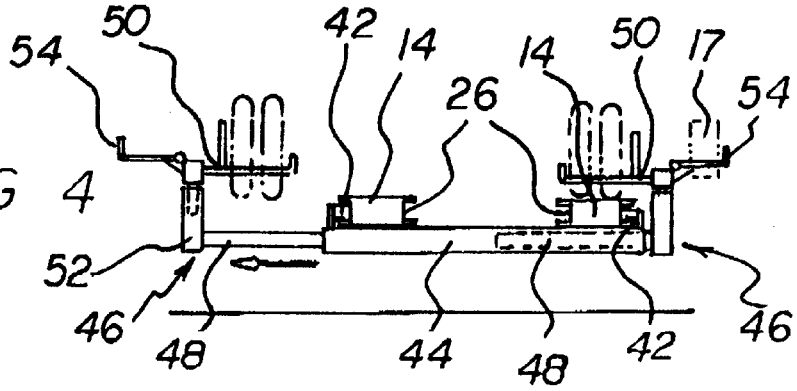
FIG. 4 is a cross-sectional view of the embodiment of the automotive lift apparatus of FIG. 1 taken along line 4—4 thereof.
Figure 5:
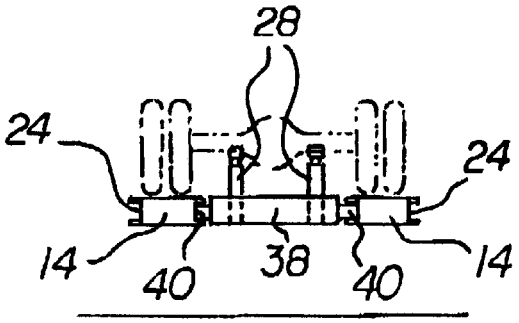
FIG. 5 is a cross-sectional view of the embodiment of the automotive lift apparatus of FIG. 1 taken along line 5—5 thereof.

As shown in FIGS. 1–5, for a motor vehicle 11 to be serviced on the automotive lift apparatus 10 of the invention, especially as shown in the broken lines in FIG. 2, the beams 14 are in lowered position, and the ramps 20 are co-planar with the beams 14. In this way, the motor vehicle 11 can be driven up the ramps 20 and the beams 14. Once the motor vehicle 11 is fully on the beams 14, the ramp lift assembly 22 is actuated, and the beams 14 are lifted to a horizontal orientation shown in the solid lines in FIG. 2. Also, as the beams are is lifted, the ramps 20 move to a vertical orientation, and the riser links 34 are also moved to a vertical orientation around their associated hinges, to a position rising above the surface of the beams 14. In this way, the riser links 34 serve as stops to prevent the motor vehicle 11 from rolling off of the beams 14. As the beams 14 are lifted, the beam support riser 84 rotates around the hinge between the beam support riser 84 and the beam support base 82. Once the motor vehicle 11 is on the beams 14, the motor vehicle 11 can be easily serviced from under the motor vehicle 11.

With the weight of the motor vehicle 11 being supported by the vehicle wheels and tires 13, the wheels and tires 13 themselves and the brakes located behind the wheels and tires 13 cannot be serviced. However, the first hydraulic jacks 28 can be positioned under the motor vehicle 11 and actuated. The first hydraulic jacks 28 are positioned by rolling of the jack carriage rollers 40 in the inward facing guide portions 26. In addition the frame jack assembly 36 can be actuated. When this is done, the vehicle frame 15 is lifted, and one or more of the wheels and tires 13 do not bear the weight of the motor vehicle 11. When this is done, the wheel lift assemblies 30 can be placed under a selected wheels and tire 13. The selected wheels and tire 13 can be loosened from the motor vehicle 11, and the selected wheels and tire 13 can be pulled away laterally from the motor vehicle 11. Selected wheels and tires 13 are supported by the wheel rack 50, and the wheel rack 50 is moved laterally by lateral movement of the extensible/contractible support rods 48 in the telescopic second utility assembly extension unit 44. Moreover. A brake drum 17 of the motor vehicle 11 can be supported by brake drum rack 54 which is supported by the wheel rack 50.

Figure 6:
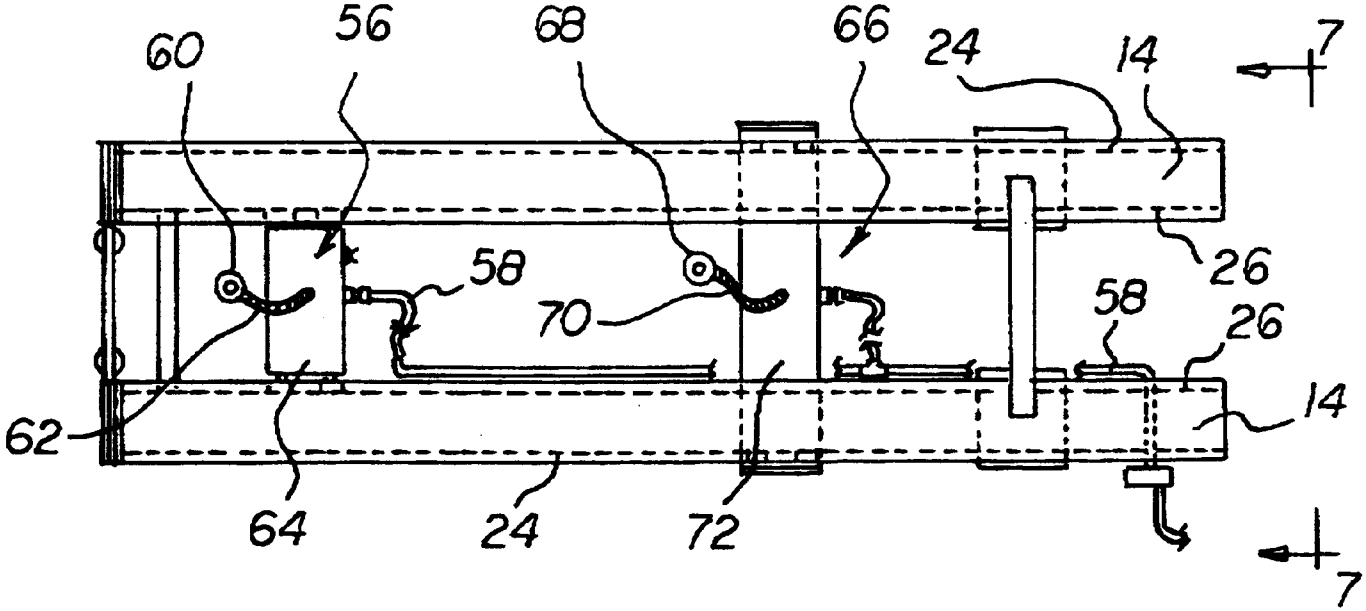
FIG. 6 is a top view of a second embodiment of the invention which includes a waste oil collection system.
Figure 7:
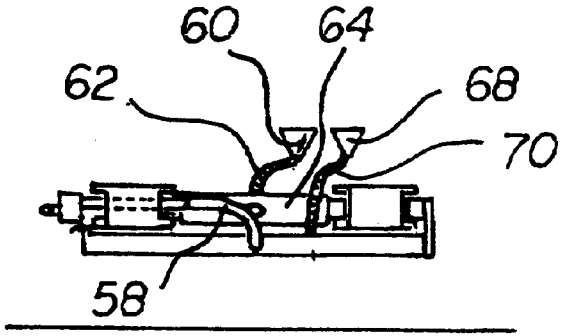
FIG. 7 is an end view of the embodiment of the invention shown in FIG. 6 taken along line 7—7 thereof.

As shown in FIGS. 6 and 7, the first utility assembly includes a first waste oil reclamation unit 56. A suction line 58 is connected to the first waste oil reclamation unit 56. The first waste fluid reclamation unit 56 includes a first reclamation funnel 60, a first flexible conduit 62 connected to the first reclamation funnel 60, and a first fluid reception tank 64 connected to the first flexible conduit 62. The suction line 58 is connected to the first fluid reception tank 64.

A fourth utility assembly is supported by the outward facing beam guide portions 24. The fourth utility assembly includes a second waste oil reclamation unit 66. The second waste oil reclamation unit 66 includes a second reclamation funnel 68. A second flexible conduit 70 is connected to the second reclamation funnel 68, and a second fluid reception tank 72 is connected to the second flexible conduit 70. The second fluid reception tank 72 is connected to the suction line 58. The first waste oil reclamation unit 56 can be positioned under a crankcase of the motor vehicle 11 while the second waste oil reclamation unit 66 can be placed under a transmission case. In this way, the first reclamation funnel 60 can receive motor oil, and the second reclamation funnel 68 can receive transmission fluid.

Figure 8:
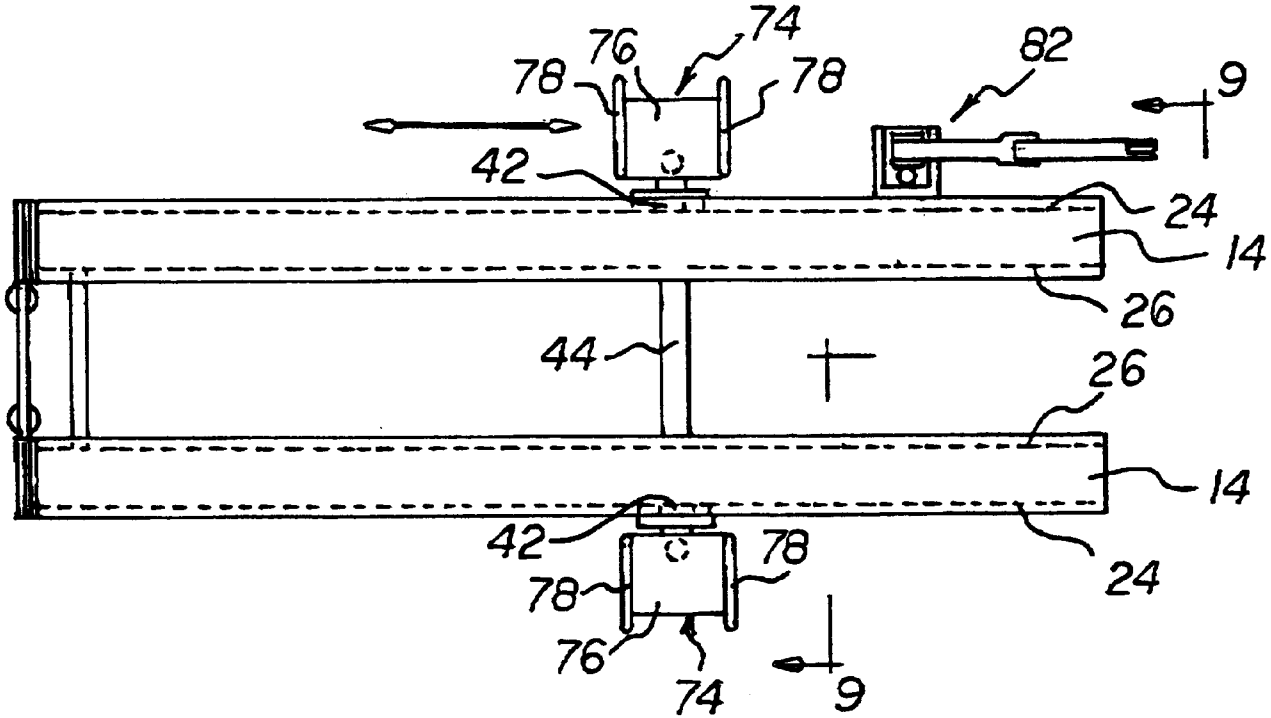
FIG. 8 is a top view of a third embodiment of the invention which includes maintenance platforms and a component hoist.
Figure 9:
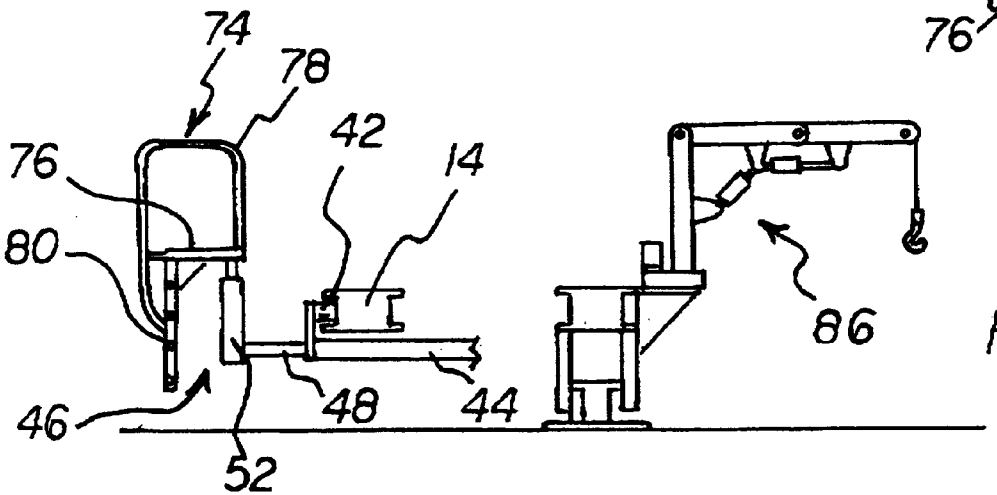
FIG. 9 is an end view of the embodiment of the invention shown in FIG. 8 taken along line 9—9 thereof.
Figure 12:
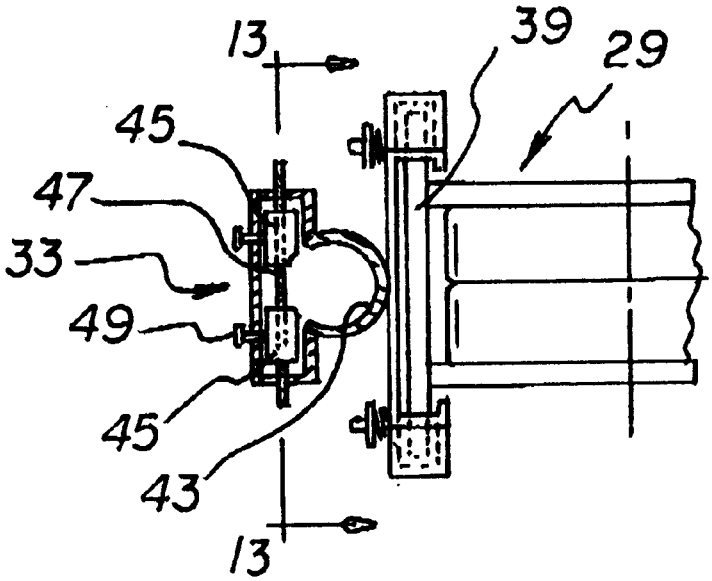
FIG. 12 a top view of the portion of the embodiment of the invention shown in FIG. 11 taken along line 12—12 thereof.
Figure 13:
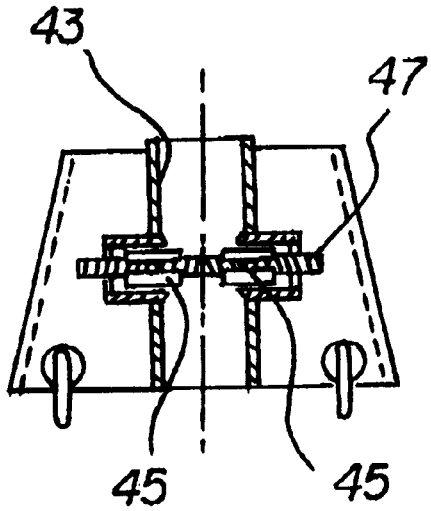
FIG. 13 is an enlarged cross-sectional view of the portion of the embodiment of the invention shown in FIG. 12 taken along line 13—13 thereof.
Figure 14:
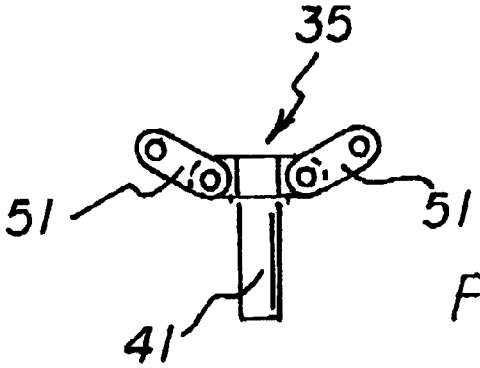
FIG. 14 is a side view of the portion of the embodiment of the invention shown in FIG. 11 taken along line 14—14 thereof.

As shown in FIGS. 8 and 9, the second utility work units 46 of the second utility assembly can include work platform assemblies 74 supported by the task performance unit support strut 52. More specifically, for each of the second utility work units 46, the respective wheel rack 50 and the respective brake drum rack 54 shown in FIG. 4 can be removed from the respective task performance unit support strut 52 and replaced with a work platform assembly 74. Each of the work platform assemblies 74 includes a platform member 76. A pair of handrails 78 extend upward from the platform member 76, and a set of stairs 80 extend downward from the platform member 76. A mechanic can stand on a platform member 76 and work under the hood of a motor vehicle 11 as the motor vehicle 11 is elevated on the beams 14. Each of the work platform assemblies 74 can be positioned at selected locations beside the motor vehicle 11 by rolling the second utility assembly rollers 42 along the outward facing beam guide portions 24.

As shown in FIGS. 8 and 9, side hoist assembly 86 is connected to a beam 14. The side hoist assembly 86 can be used to lift components upward from the motor vehicle 11 and swing them to the side of the motor vehicle 11.

As shown in FIGS. 10 through 14, interior hoist assembly 21 is supported by the inward facing guide portions 26 of the beams 14. The interior hoist assembly 21 includes an interior hoist carriage assembly which includes rollers 27 supported by the inward facing guide portions 26. A pair of roller support struts 25 is connected to the rollers 27. A transverse carriage strut 23 is connected between the pair of roller support struts 25. An interior hoist unit 29 is provided, and a pivot 31 connects the interior hoist unit 29 to the transverse carriage strut 23. A rotator assembly, which includes hydraulic cylinders and pistons, is connected between one of the roller support struts 25 and the interior hoist unit 29 for rotating the interior hoist unit 29 around the pivot 31.

The interior hoist unit 29 includes a fixture reception assembly 33, and a fixture 35 is received in the fixture reception assembly 33. The fixture reception assembly 33 includes a fixture reception channel 43 for receiving a portion of the fixture 35, and a fixture securing assembly secures the fixture 35 to the fixture reception assembly 33. The fixture securing assembly includes an externally threaded cam reception shaft 47. A pair of internally threaded locking cams 45 is connected to the threaded cam reception shaft 47, and a pair of cam drivers 49 are provided for moving the locking cams 45 along the threaded cam reception shaft 47. The fixture 35 includes a vertical stem 41 inserted into the fixture reception channel 43, and a horizontal rest assembly 51 is supported by the vertical stem 41.

The interior hoist assembly 21 is positioned between the beams 14 by rolling the rollers 27 along the inward facing guide portions 26. The interior hoist unit 29 is used for raising and lowering the fixture reception assembly 33. The pivot 31 is used for swinging the interior hoist unit 29 with respect to the transverse carriage strut 23. When one fixture 35 is to be replaced by another fixture 35, the cam drivers 49 are turned so that the locking cams 45 move longitudinally along the threaded cam reception shaft 47 away from the vertical stem 41 of the fixture 35 that is received in the fixture reception channel 43. When the locking cams 45 release their locking grip on the vertical stem 41, the fixture 35 can easily be removed and replaced by another fixture 35. Then, the new fixture 35 can be locked in the fixture reception assembly 33 by reversing direction of movement of the locking cams 45 and locking the locking cams 45 onto the vertical stem 41 of the new fixture 35.

The components of the automotive lift apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved automotive lift apparatus that is low in cost, relatively simple in design and operation, and which may advantageously be used to lift a motor vehicle without requiring the use of in-ground pit. With the invention, an automotive lift apparatus is provided which does not require an in-ground pedestal. With the invention, an automotive lift apparatus is provided which lifts the wheels of the vehicle off of the rack. With the invention, an automotive lift apparatus is provided which includes features for receiving and removing waste oil from the motor vehicle. With the invention, an automotive lift apparatus provides two motor vehicle jacks so that both the front and the rear of the vehicle can be jacked up to maintain the jacked up vehicle in a level orientation. With the invention, an automotive lift apparatus is provided which includes an overhead hoist assembly. With the invention, an automotive lift apparatus provides an overhead hoist that can be located at substantially any longitudinal position along the ramps of the apparatus. With the invention, an automotive lift apparatus provides an elevated work platform upon which an automobile mechanic can stand while doing work under the hood of the motor vehicle. With the invention, an automotive lift apparatus provides an easily operated locking system to lock interchanged fixtures into the hoist. With the invention, an automotive lift apparatus provides a mechanism for moving wheels and brake drums away from a vehicle.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An automotive lift apparatus, comprising:

a first beam support assembly, a pair of beams supported at first beam ends by said first beam support assembly, wherein each of said beams includes an outward facing beam guide portion and an inward facing guide portion, and a pair of ramp/second beam support assemblies connected to second beam ends of said beams, wherein each of said ramp/second beam support assemblies includes a second base, a liftable ramp hingedly connected to said second base, and a ramp lift assembly connected between said ramp and said second base, wherein said first beam support assembly includes a beam support base and a beam support riser pivotally connected to said beam support base, wherein each of said ramp lift assemblies includes a ramp-lift hydraulic cylinder connected between said second base and said ramp, and wherein each of said ramp/second beam support assemblies includes a riser link hingedly connected between each of said ramps and said second beam ends.

2. The apparatus of claim 1, further including:

a first utility assembly supported by said inward facing guide portions.

3. The apparatus of claim 2 wherein said first utility assembly includes vertically oriented first hydraulic jacks.

4. The apparatus of claim 3 wherein said first hydraulic jacks are carried by a jack carriage assembly which includes jack carriage rollers received in said inward facing guide portions.

5. The apparatus of claim 2, further including a rotator assembly connected between one of said roller support struts and said interior hoist unit for rotating said interior hoist unit around said pivot.

6. The apparatus of claim 2 wherein said first utility assembly includes a first waste oil reclamation unit.

7. The apparatus of claim 6, further including a suction line connected to said first waste oil reclamation unit.

8. The apparatus of claim 6 wherein said first waste fluid reclamation unit includes:

a first reclamation funnel, a first flexible conduit connected to said first reclamation funnel, and a first fluid reception tank connected to said first flexible conduit, wherein said suction line is connected to said first fluid reception tank.

9. The apparatus of claim 1, further including:

a second utility assembly supported by said outward facing beam guide portions.

10. The apparatus of claim 9 wherein said second utility assembly includes:

second utility assembly rollers received in said outward facing beam guide portions, a telescopic second utility assembly extension unit suspended from said second utility assembly rollers and extending transversely below said beams, and second utility work units supported by said telescopic second utility assembly extension unit.

11. The apparatus of claim 10 wherein each of said second utility work units includes:

an extensible/contractible support rod received in said telescopic second utility assembly extension unit, a task performance unit support strut supported by said extensible/contractible support rod, and a task performance unit supported by said task performance unit support strut.

12. The apparatus of claim 11 wherein said task performance unit includes a wheel rack.

13. The apparatus of claim 11 wherein said task performance unit includes a brake drum rack.

14. The apparatus of claim 10 wherein said second utility work units of said second utility assembly can include work platform assemblies supported by said task performance unit support strut.

15. The apparatus of claim 14 wherein each of said work platform assemblies includes:

a platform member, a pair of handrails extending upward from said platform member, and a set of stairs extending downward from said platform member.

16. The apparatus of claim 1, further including a side hoist assembly connected to a beam.

17. The apparatus of claim 1, further including a fourth utility assembly supported by said outward facing beam guide portions.

18. The apparatus of claim 17 wherein said fourth utility assembly includes a second waste oil reclamation unit.

19. The apparatus of claim 18 wherein said second waste oil reclamation unit includes:

a second reclamation funnel, a second flexible conduit connected to said second reclamation funnel, and a second fluid reception tank connected to said second flexible conduit, wherein said second fluid reception tank is connected to said suction line.

20. The apparatus of claim 1, further including a third utility assembly supported by said first beam support assembly.

21. The apparatus of claim 20 wherein said third utility assembly includes a frame jack assembly.

22. The apparatus of claim 1, further including an interior hoist assembly supported by said inward facing guide portions of said beams.

23. The apparatus of claim 22 wherein said interior hoist assembly includes:

an interior hoist carriage assembly which includes rollers supported by said inward facing guide portions, a pair of roller support struts connected to said rollers, a transverse carriage strut connected between said pair of roller support struts, an interior hoist unit, and a pivot connecting said interior hoist unit to said transverse carriage strut.

24. The apparatus of claim 22 wherein said interior hoist unit includes:

a fixture reception assembly, and a fixture received in said fixture reception assembly.

25. The apparatus of claim 24 wherein said fixture reception assembly includes:

a fixture reception channel for receiving a portion of said fixture, and a fixture securing assembly for securing said fixture to said fixture reception assembly.

26. The apparatus of claim 25 wherein said fixture securing assembly includes:

an externally threaded cam reception shaft, a pair of internally threaded locking cams connected to said threaded cam reception shaft, and a pair of cam drivers for moving said locking cams along said threaded cam reception shaft.

27. The apparatus of claim 25 wherein said fixture includes:

a vertical stem inserted into said fixture reception channel, and a horizontal rest assembly supported by said vertical stem.

* * * * *